US011293731B2

(12) United States Patent
Crouch et al.

(10) Patent No.: US 11,293,731 B2
(45) Date of Patent: Apr. 5, 2022

(54) NON-LETHAL NAVAL VESSEL INTERDICTION WEAPON

(71) Applicant: RAYTHEON COMPANY, Waltham, MA (US)

(72) Inventors: David D. Crouch, Eastvale, CA (US); David R. Sar, Corona, CA (US); Michael J. Holihan, Santa Clarita, CA (US); Alf L. Carroll, III, Marion, MA (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 16/828,200

(22) Filed: Mar. 24, 2020

(65) Prior Publication Data

US 2021/0278183 A1 Sep. 9, 2021

Related U.S. Application Data

(62) Division of application No. 15/822,939, filed on Nov. 27, 2017, now Pat. No. 10,619,983.

(51) Int. Cl.

| | |
|---|---|
| ***B63G 13/00*** | (2006.01) |
| ***F42B 19/00*** | (2006.01) |
| ***F42B 30/14*** | (2006.01) |
| *B63G 8/00* | (2006.01) |

(52) U.S. Cl.

CPC ..... *F42B 19/00* (2013.01); *B63G 13/00* (2013.01); *F42B 30/14* (2013.01); *B63G 2008/004* (2013.01)

(58) Field of Classification Search

CPC ..... B63G 8/001; F42B 15/36; F42B 19/00

USPC ..... 102/399; 114/20.1, 316, 382, 377, 378

See application file for complete search history.

(56) References Cited

U.S. PATENT DOCUMENTS

| | | | |
|---|---|---|---|
| 3,601,055 | A | 8/1971 | Crockett |
| 4,356,662 | A | 11/1982 | Strasser et al. |
| 5,137,193 | A | 8/1992 | McDonald |
| 5,214,618 | A | 5/1993 | Bugiel |
| 5,448,941 | A | 9/1995 | Godfrey et al. |

(Continued)

FOREIGN PATENT DOCUMENTS

| | | | |
|---|---|---|---|
| WO | 2005118390 | A1 | 12/2005 |
| WO | 2006065227 | A1 | 6/2006 |
| WO | 2008060243 | A1 | 5/2008 |

OTHER PUBLICATIONS

BCB, "Non-Lethal Boat Stopping Systems", URL<bcbin.com/wp-content/uploads/2015/03/Boat-Stopping-Systems-Description.pdf>, 2015, 7 pages.

(Continued)

*Primary Examiner* — Reginald S Tillman, Jr.
(74) *Attorney, Agent, or Firm* — Cantor Colburn LLP

(57) ABSTRACT

A non-lethal naval vessel interdiction weapon is provided. The non-lethal naval vessel interdiction weapon includes a hydrodynamic hull, guidance and delivery systems housed in the hydrodynamic hull with the delivery system being controllable by the guidance system to drive a naval vessel impeding payload toward a target and a deployment system. The deployment system is configured to prepare the hydrodynamic hull for payload deployment and to deploy the naval vessel impeding payload toward the target following hull preparation.

19 Claims, 6 Drawing Sheets

(56) References Cited

U.S. PATENT DOCUMENTS

| | | | | |
|---|---|---|---|---|
| 6,591,774 | B2 | 7/2003 | Metherell et al. | |
| 8,552,282 | B1 * | 10/2013 | Garcia | F41G 7/2206 114/23 |
| 9,308,970 | B1 | 4/2016 | Gefken et al. | |
| 2005/0116090 | A1 | 6/2005 | Welty et al. | |
| 2012/0160145 | A1 * | 6/2012 | Gavish | E05B 73/007 114/145 R |

OTHER PUBLICATIONS

ISR/WO, Issued Apr. 12, 2019, RAY0375PCT, PCT Application No. 179919-WOPCT, 15 pages.

* cited by examiner

NON-LETHAL NAVAL VESSEL INTERDICTION WEAPON

CROSS-REFERENCE TO RELATED APPLICATIONS

This application is a Divisional of Non-Provisional application Ser. No. 15/822,939 Filed Nov. 27, 2017, the disclosure of which is incorporated herein by reference in its entirety.

BACKGROUND

The present disclosure relates to a non-lethal, naval vessel interdiction weapon and, more particularly, to a non-lethal weapon for small vessel or large vessel interdiction.

One of the most important issues facing certain military, commercial and private naval operations is the ever-present risk of facing hostile action in the form of aggressive actions taken by a number or swarm of small vessels against a larger one. For example, a number of small ships can surround a relatively large US Navy warship and threaten to attack it or impede its progress. In such a case, the US Navy warship can almost never respond with lethal force without being commanded to do so unless one or more of the small ships take certain hostile acts for which the US Navy warship's rules of engagements dictate lethal responsiveness. Even then, given the potential for an asymmetric response by the US Navy warship, the desirability of such responsive actions may be limited.

For this and other cases, non-lethal weaponry has been developed. Such non-lethal weaponry may relate to low-tech or high-tech solutions. Low-tech weapons may include water cannons, pepper sprays, rubber bullets and loud sound emission devices while high-tech weaponry may include for example electro-magnetic (EM) weaponry (e.g., weapons that can send out EM pulses that can disable electronic systems in hostile vehicles). In any case, existing solutions are typically not suitable for naval use or are prohibitively expensive and insufficient for stopping or impeding hostile naval vessels.

SUMMARY

According to one embodiment, a non-lethal naval vessel interdiction weapon is provided. The non-lethal naval vessel interdiction weapon includes a hydrodynamic hull, guidance and delivery systems housed in the hydrodynamic hull with the delivery system being controllable by the guidance system to drive a naval vessel impeding payload toward a target and a deployment system. The deployment system is configured to prepare the hydrodynamic hull for payload deployment and to deploy the naval vessel impeding payload toward the target following hull preparation.

According to another embodiment, a non-lethal weapons system is provided for interdiction of a swarm of naval vessels. The non-lethal weapons system includes non-lethal weapons, a launcher configured to launch each non-lethal weapon into water for interdiction operations and a processor configured to provide a tactically useful hostile intent assessment alert and to manage identification and targeting of a corresponding naval vessel for each of the non-lethal weapons. Each non-lethal weapon includes a hydrodynamic hull, guidance and delivery systems housed in the hydrodynamic hull with the delivery system being controllable by the guidance system to drive a naval vessel impeding payload toward the corresponding naval vessel and a deployment system. The deployment system is configured to prepare the hydrodynamic hull for payload deployment and to deploy the naval vessel impeding payload toward the corresponding naval vessel following hull preparation.

According to yet another embodiment, a non-lethal weapon for small vessel or large vessel interdiction is provided. The non-lethal weapon includes a hull, guidance and delivery systems, a payload and a deployment system. The hull includes a tail, a nosecone, a payload section interposed between the tail and the nosecone, and a cutting system operable to separate the nosecone from the payload section. The guidance and delivery systems are housed in the hull with the delivery system being controllable by the guidance system to drive the payload section toward a target. The payload is housed in the payload section and includes a harpoon attachable to the target upon deployment thereof and an anchoring element coupled to the harpoon and configured to anchor the target with the harpoon attached thereto. The deployment system is configured to operate the cutting system and to deploy at least the harpoon toward the target following nosecone separation. The guidance, delivery and deployment systems are configured for engagement in response to issuance of a tactically useful hostile intent assessment alert.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
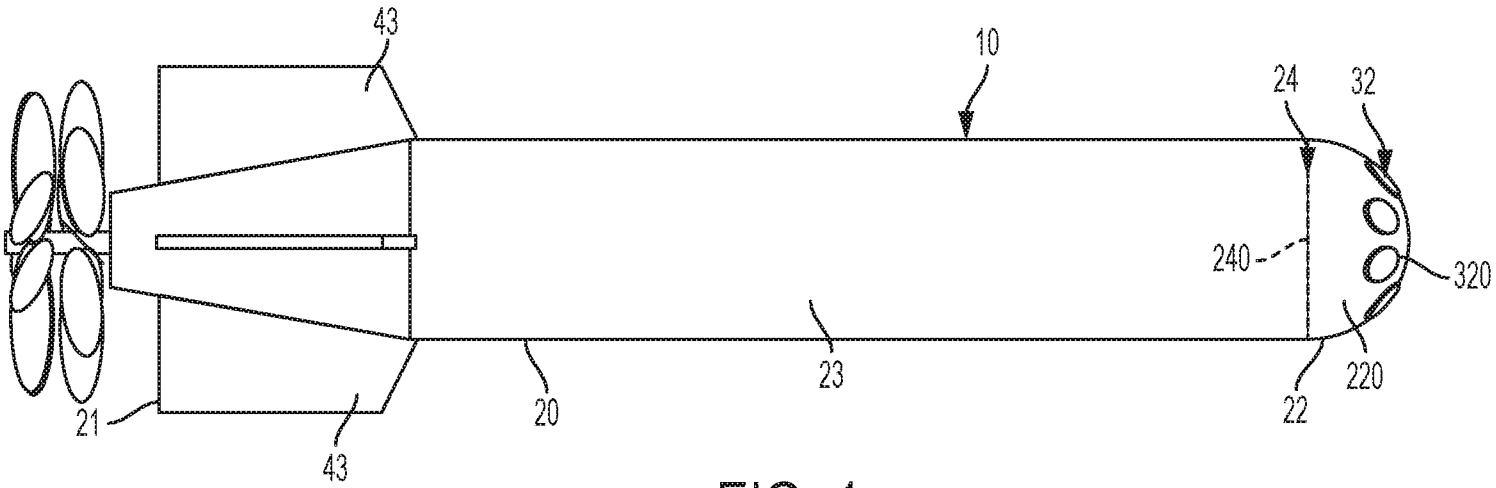
FIG. 1 is a side view of a non-lethal weapon in accordance with embodiments.

As will be described below, a non-lethal weapon is provided and may be configured as a low-cost, self-guiding torpedo or missile that delivers a harpoon-tethered sea anchor to its target. The non-lethal weapon is thus capable of slowing down or incapacitating the target without inflicting lethal damage to the target or its occupants. The non-lethal weapon is thus usable by naval personnel in situations that do not call for or permit lethal action to be taken or commercial personnel or private persons who are confronted with situations that they regard as threatening or dangerous.

With reference to FIGS. 1-4, a non-lethal weapon 10 is provided for use with small vessel or large vessel interdiction. The non-lethal weapon 10 includes a hydrodynamic hull 20, a guidance system 30 with an active or passive sensor suite having at least one or more of a camera, a laser, a light, an inertial measurement unit (IMU), a compass or any other suitable sensor or related component (to be discussed in greater detail below), a delivery system 40, a naval vessel impeding payload (hereinafter referred to as a "payload") 50 and a deployment system 60. The guidance system 30, the delivery system 40 and the deployment system 60 are each configured for automatic or commanded engagement in response to issuance of a tactically useful hostile intent assessment alert.

The hydrodynamic hull 20 may be shaped like a torpedo or a missile and includes a tail 21, a nosecone 22, a payload section 23 interposed between the tail 21 and the nosecone 22, and a cutting system 24. The cutting system 24 is operable to separate the nosecone 22 from the payload section 23 and may be provided as a series of charges 240 disposed along the base of the nosecone 22 and/or as a series of charges 240 disposed along sides of the nosecone 22 to define breakaway nosecone plates (see FIG. 4).

The guidance system 30 (which is receptive of input from one or more sensors of the sensor suite) and the delivery system 40 are respectively housed in the hydrodynamic hull 20 with the delivery system 40 being controllable by the guidance system 30 to drive the payload section 23 toward a target. The payload 50 is housed in the payload section 23 and includes a harpoon 51 which is attachable to the target upon deployment thereof and an anchoring element 52. The anchoring element 52 is coupled to the harpoon 51 and configured to anchor the target with the harpoon 51 attached thereto. The deployment system 60 is configured to prepare the hydrodynamic hull 20 for payload deployment by for example operating the cutting system 24 and to subsequently deploy at least the harpoon 51 toward the target following the separation of the nosecone 22 from the payload section 23.

In accordance with embodiments, the hydrodynamic hull 20, the guidance system 30, the delivery system 40, the deployment system 60 and the payload 50 are operable underwater in a freshwater or a seawater environment. It is to be understood, however, that the present invention is not limited to underwater operations and that other types of engagements are possible. These include air- and ground-based operations in which the hydrodynamic hull 20 might be replaced with an aerodynamic hull or a vehicle chassis, respectively. The following disclosure will relate only to underwater operations for purposes of clarity and brevity.

To the extent that the non-lethal weapon 10 is operable underwater the hydrodynamic hull 20 may be shaped like a missile or a torpedo but may be substantially smaller than a conventional missile or torpedo. For example, the hydrodynamic hull 20 may be ~2 to ~3 feet long with a ~4 inch diameter and a capability to operate at up to 10 meter depths with a top speed of ~25 knots and a limited ~1-2 km range.

Figure 2:
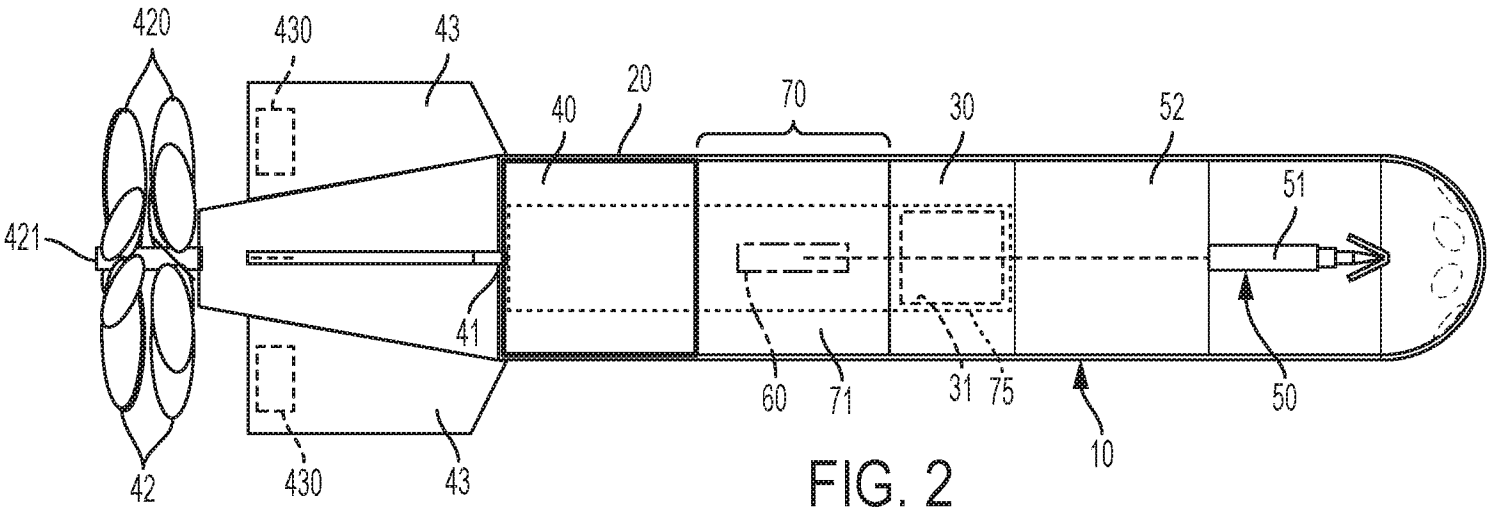
FIG. 2 is a side cutaway view of the non-lethal weapon of FIG. 1 in accordance with embodiments.
Figure 4:
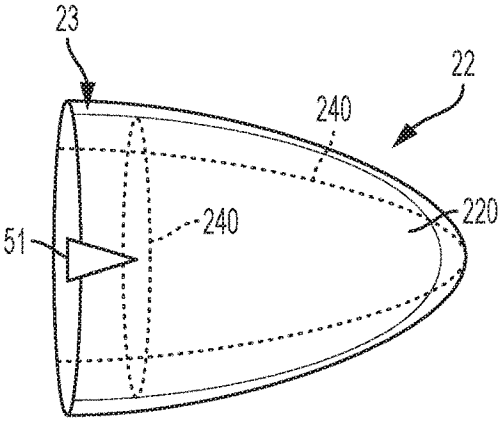
FIG. 4 is an enlarged perspective view of a nosecone of the non-lethal weapons of FIGS. 1 and 2.

As shown in FIG. 2, the non-lethal weapon 10 may further include a power supply 70 and a processing unit 75. Both the power supply 70 and the processing unit 75 are respectively housed in the hydrodynamic hull 20 and both are provided for respective use at various points or mission events by at least one of the guidance system 30, the delivery system 40 and the deployment system 60. In accordance with embodiments, the power supply 70 may be disposed within the hydrodynamic hull 20 at an axial location forward of a propulsion unit 41 of the delivery system 40 and aft of a guidance and control unit 31 of the guidance system 30. In that location, the power supply 70 may be provided as a set of batteries 71, fuel or some other suitable feature which is capable of storing energy for use by the guidance system 30, the delivery system 40 and the deployment system 60. In the case of the power supply 70 being provided as a set of batteries 71, the batteries 71 may include zinc/silver oxide batteries with high storage density and long shelf lives (e.g., ~8 years). The processing unit 75 may be provided as one or more central processing units (CPUs) or as a distributed processor that is embodied in at least the guidance system 30, the delivery system 40 and the deployment system 60.

Figure 3:
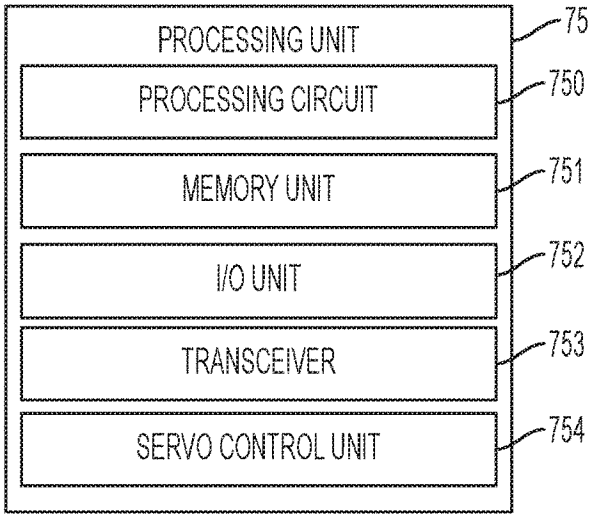
FIG. 3 is a schematic diagram illustrating components of a processing unit of the non-lethal weapon of FIGS. 1 and 2 in accordance with embodiments.

As shown in FIG. 3, the processing unit 75 may include a processing circuit 750, a memory unit 751, an input/output (I/O) unit 752, a transceiver 753 and a servo control unit 754. The processing circuit 750 is receptive of data and information from the guidance system 30 (e.g., the guidance and control unit 31) via the I/O unit 752 in order to determine the location of the non-lethal weapon 10 relative to given point (e.g., a mothership, a point in space or a point defined by a global positioning system) and/or relative to the target. The processing circuit 750 is also receptive of data and information from a central command center or a mothership via the transceiver 753 such that the processing circuit 750 can receive mission planning and control commands and/or targeting information, such as which vessel in a swarm of vessel to identify as the target.

In accordance with embodiments, the non-lethal weapon 10 may be autonomous after launch or commanded at one or more operational moments. In the cases in which the non-lethal weapon 10 is commanded, data exchange between the non-lethal weapon 10 and a command center or mothership can be conducted via multiple methods, processes and systems. For example, data can be exchanged acoustically, the non-lethal weapon 10 can spool a cable (fiber optic or coaxial) over which data is exchanged with the mothership and the non-lethal weapon 10 may be provided as part of a hand-held launcher system that is analogous to a TOW missile and be optically tracked and wire guided.

The memory unit 751 may be provided with various types of random access and read only memory and has executable instructions, which are readable and executable by the processing circuit 750, stored thereon. When executed by the processing circuit 750, the executable instructions cause the processing unit 750 to receive the data and information via the I//O unit 752 and the transceiver 753, to determine actions to take in accordance with the received data and information and to issue commands to the servo control unit 754 for taking those determined actions. The servo control unit 754 may be coupled, for example, to at least the delivery system 40 and the deployment system 60 and configured to control respective operations of the guidance system 30, the delivery system 40 and the deployment system 60.

In accordance with embodiments, when the executable instructions are executed, the executable instructions may cause the processing circuit 750 to execute a tactically useful hostile intent assessment. In such cases, the processing circuit 750 analyzes current data relating to potential hostile parties and, either automatically or under command, makes a hostile intent assessment and issues an alert accordingly. The initiation, engagement, activation and/or operation of the guidance system 30, the delivery system 40 and the deployment system 60 may be based at least initially on the hostile intent assessment being made and the alert being issued accordingly.

As shown in FIG. 1, the guidance system 30 includes the guidance and control unit 31 and a seeker element 32. The seeker element 32 may be disposed in the nosecone 22 and is communicative with the guidance and control unit 31. In accordance with embodiments, the seeker element 32 may include or be provided as a passive acoustic array 320 of acoustic elements disposed about an exterior curved surface 220 of the nosecone 22. The passive acoustic array 320 may be cued by acoustic signatures of target propulsion and may acquire and track the target thereby. Alternatively, the guidance system 30 may include an active acoustic array or a T/R module that actively seeks out, acquires and tracks potential targets or otherwise receives targeting information directly from a command center or a mothership. The guidance and control unit 31 may be a stand-alone component that communicates with the processing circuit 750 via the I/O unit 752 or a component of the processing unit 75 that communicates with other components of the processing unit 75 via the I/O unit 752.

As shown in FIG. 2, the delivery system 40 may include the propulsion unit 41 and propellers 42. The propulsion unit 41 may be disposed in the tail 21 or an aft end of the payload section 23. The propulsion unit 41 may include or be provided as an electric motor which could be quieter than a chemically-fueled combustion engine of similar size and may be a commercial off-the-shelf (COTS) model or a model that is engineered specifically for high-performance, one-time usage in the non-lethal weapon 10. In accordance with alternative embodiments, the propulsion unit 41 may also include or be provided with a supply of fuel and a combustion engine in which the fuel can be combusted to generate propulsion energy. In accordance with still further alternative embodiments, the propulsion unit 41 may include or be provided with compressed air or gas to be used for propulsion. As shown in FIG. 2, the propellers 42 may be configured as coaxial, counter-rotating rotating propellers 420 that are disposed on rotatable shaft(s) 421 extending aft from the tail section 21. Blade pitch of the propellers 42 may be collectively or cyclically controllable and, in addition or as an alternative, a pitch of the rotatable shaft(s) 421 may be variable. In accordance with alternative embodiments, the propellers 42 may be supplemented with or replaced by alternative driving features such as, but not limited to, exhaust elements in which compressed air, gas, or water is expanded and expelled in the aft direction in order to propel the non-lethal weapon 10 forward.

In accordance with further embodiments, the non-lethal weapon 10 may also include or be provided with hydrodynamic (or aerodynamic) surfaces, such as fins 43, extending outwardly from the tail section 21 or another portion of the hydrodynamic hull 20. Such fins 43 may be static or dynamically controllable. In the latter case, trailing edges of the fins 43 may include flaps 430 that are independently pivotable relative to the fins 43 in order to increase control of the propulsion of the non-lethal weapon 10.

During operations of the non-lethal weapon 10, the guidance system 30 effectively controls one or more features of the delivery system 40. That is, to the extent that the guidance system 30 identifies and tracks a target, the guidance system 30 can instruct the delivery system 40 to increase or decrease the speed of the forward propulsion provided by the propellers 42 (i.e., by collectively increasing the pitch of the propellers 42) or, as the target changes direction, the guidance system 30 can instruct the delivery system 40 to change the direction of the forward propulsion (i.e., by cyclically changing the pitch of the propellers 42 or modifying the pitch of the flaps 430). In addition, while the guidance system 30 and the delivery system 40 normally operate in a high power or normal mode in which the non-lethal weapon identifies, tracks and moves toward a target, this is not required in all cases. For example, in an event the target enters a quiet mode or shuts down, the guidance system 30 and the delivery system 40 can correspondingly enter a low power mode during which at least the guidance system 30 and the delivery system 40 consume a minimum of power from the power supply 70.

Figure 7:
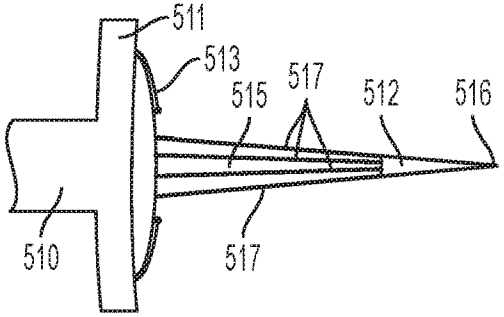
FIG. 7 is an enlarged side view of a forward portion of the harpoon of FIG. 5 in accordance with embodiments.
Figure 8:
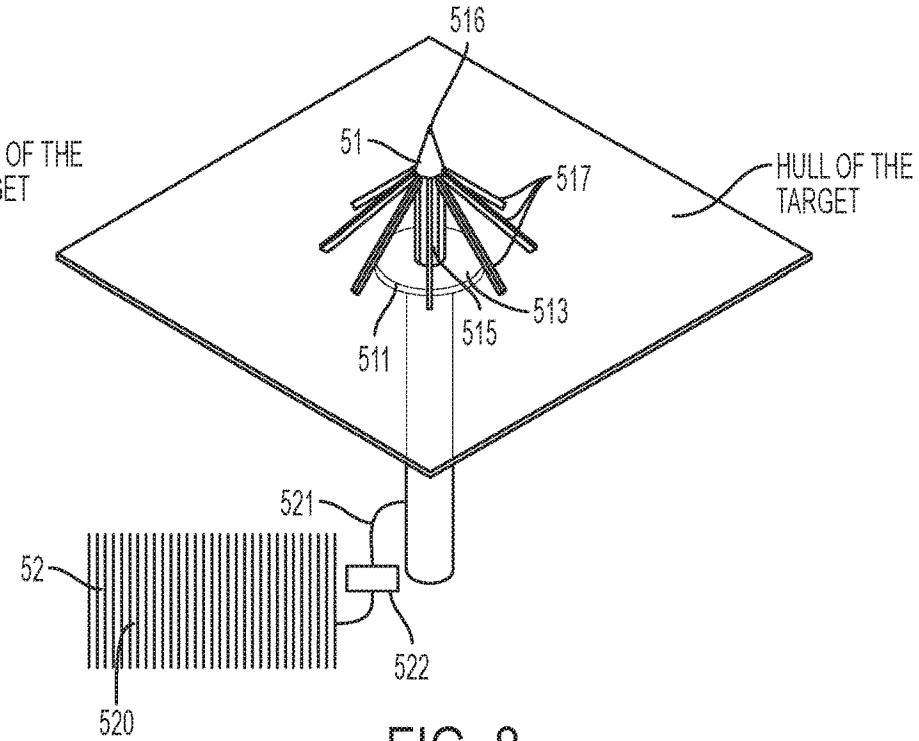
FIG. 8 is a perspective view of a late operational state of the harpoon of FIG. 5.
Figure 9:
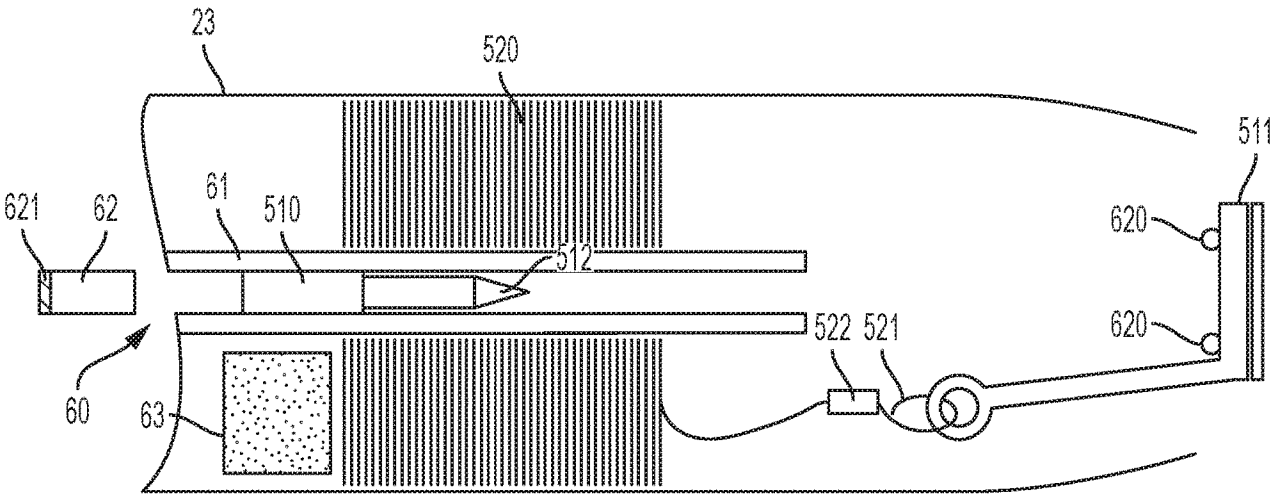
FIG. 9 is a side view of an initial operational state of a harpoon in accordance with alternative embodiments.
Figure 10:
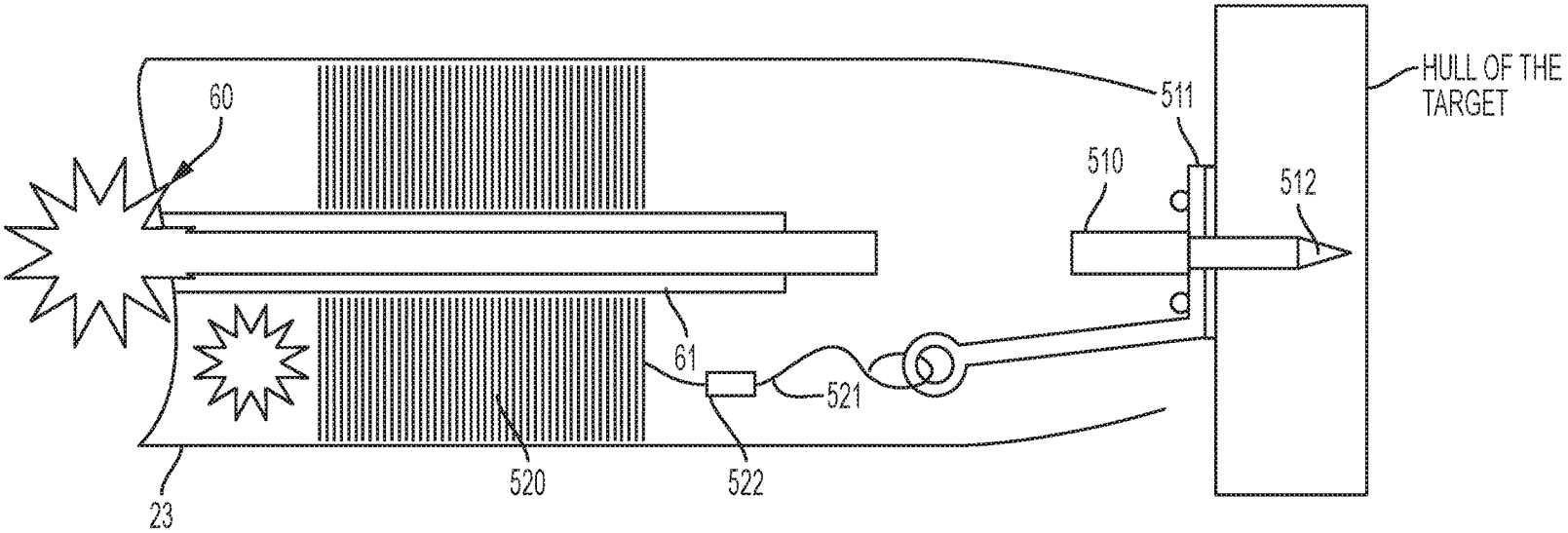
FIG. 10 is a side view of a late operational state of the harpoon of FIG. 9.

With reference to FIGS. 5-8, the harpoon 51 includes a barrel 510, a flange 511 and a barbed front end 512. The barrel 510 is an elongate member which is formed of substantially rigid materials and which is stowed in a pre-deployment condition with its rear end disposed in a firing barrel 61 of the deployment system 60. The flange 511 may be provided as a radial extension of the barrel 510 which is integrally coupled to or otherwise affixed to a forward end of the barrel 510 aft of the barbed front end 512 (the flange 511 may also be disconnected from the barrel as shown in FIGS. 9 and 10 to be discussed below). The barbed front end 512 extends forwardly from the barrel 510 and is forcibly injectable through the hull of the target upon the deployment of the harpoon 51 by the deployment system 60 such that the harpoon 51 continues to travel forwardly until the flange 511 abuts with the hull of the target (see FIG. 6) at which point the barbed front end 512 engages and impedes withdrawal of the harpoon 51 from the hull of the target (see FIG. 8).

As shown in FIG. 7, a forward side of the flange 511 may be curved to match a curvature of the hull of the target and may be partially covered with a sealant 513 formed of polyisobutylene, for example, or with a peel-away layer formed of Teflon™, for example. The sealant 513 may be provided to seal a hole in the hull of the target following the injection of the harpoon 51 and to thereby prevent or at least delay a sinking of the target by the non-lethal weapon 10. As shown in FIG. 8, the barbed front end 512 may include a central post 515 having a sharp forward point 516 at its end and barbs 517 which are pivotable about the sharp forward point 516 to extend outwardly from the central post 515 post-injection. The barbs 517 may be spring-loaded and, when extended, prevent a withdrawal of the barbed front end 512 from the hull of the target and thus allow the anchoring element 52 to slow down the target.

The presence of the sealant 513 also inhibits attempts to remove the barbed front end 512 and the barbs 517 from the hull of the target. The sealant 513 may also be provided with an anti-tamper feature that can be enhanced by the inclusion of sharp metal barbs and/or rapid-cure metallic-enhanced polymer adhesives.

With reference to FIGS. 9 and 10 and in accordance with alternative embodiments, the flange 511 may be separate from the barrel 510 at least initially. In these cases, the flange 511 may be disposed at or near the front end of the payload section 23 and the base of the nosecone 22 with the barrel 510 stowed in the firing barrel 61. In addition, the barrel 510 may include a shoulder section which is wider than the barbed front end 512 or the front end of the barrel 510. As shown in FIGS. 9 and 10, the flange 511 may initially about the hull of the target and, once the deployment system 60 deploys the harpoon 51, the harpoon 51 is forcibly injected into and through the flange 511 and then the hull of the target in essentially one motion. The forward motion of the barrel 510 and the barbed front end 512 is stopped by the interference between the shoulder section of the barrel 510 and the aft side of the flange 511.

Figure 5:
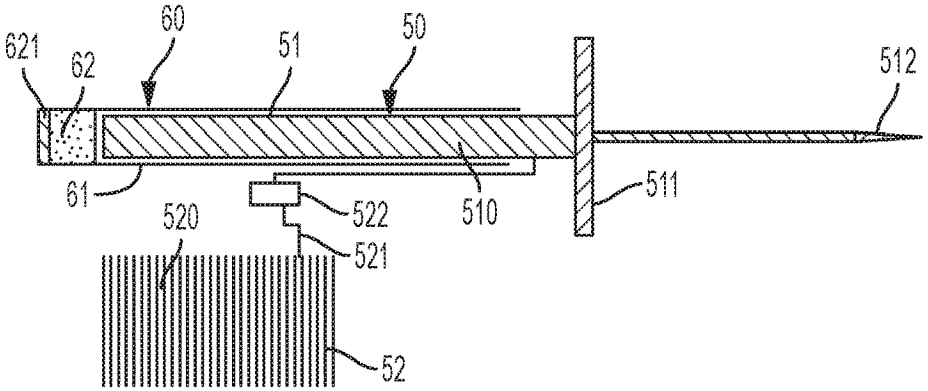
FIG. 5 is a side view of a harpoon of a non-lethal weapon in accordance with embodiments.
Figure 6:
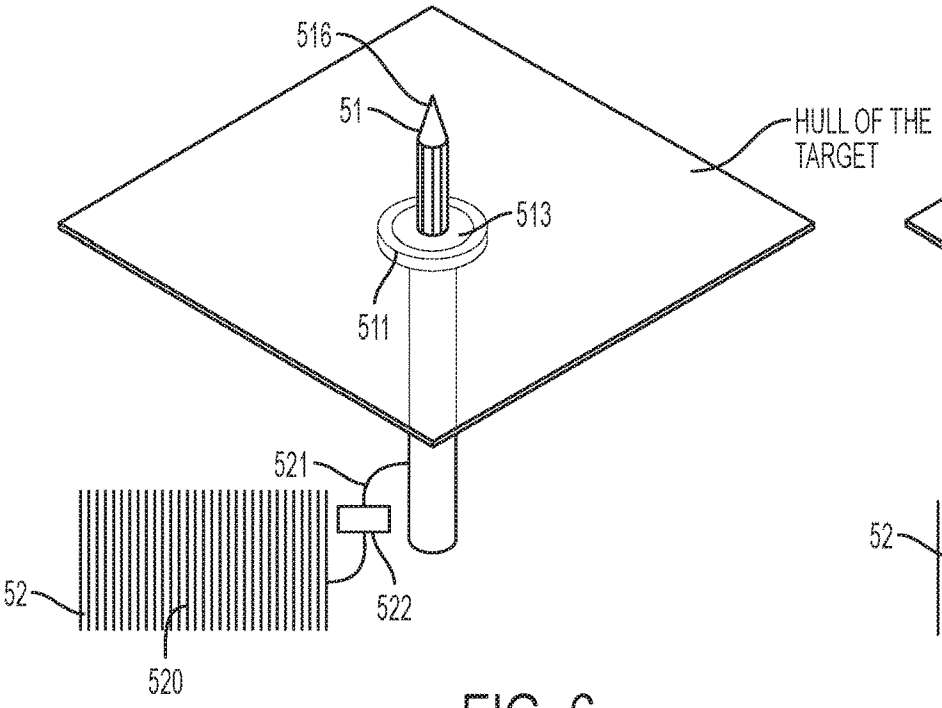
FIG. 6 is a perspective view of an initial operational state of the harpoon of FIG. 5.

With reference to FIGS. 5, 6, 8, 9 and 10 (and FIG. 11 to be described below), the anchoring element 52 may include a sea anchor 520 and a tether 521. The sea anchor 520 may include or be provided as an underwater parachute (see FIG. 11), for example, a net or as fibrous or metallic element or web that fouls a propeller of the target. The sea anchor 520 may be formed of materials which tend to sink or remain underwater or, in accordance with additional embodiments, the anchoring element 52 may include a weight or, where minimizing size and weight is a primary concern, a hydrodynamic depressor 522 that is attachable to the sea anchor 520 or the tether 521. In accordance with embodiments, the tether 521 may be attachable to the barrel 510 as shown in FIGS. 6 and 8 or to a rear section of the flange 511 as shown in FIGS. 9 and 10. In any case, the sea anchor 520 may be stowed within the payload section 23 at an exterior of the firing barrel 61 so as to avoid damage to the sea anchor 520 during deployment.

With continued reference to FIGS. 5 and 9, the deployment system 60 may include the firing barrel 61 and a charge 62. The charge 62 may be accommodated within a rear end of the firing barrel 61 and is sized and configured to propel the harpoon 51 out of the firing barrel 61 and into and through at least the hull of the target. In accordance with embodiments and as shown in FIG. 9, the deployment system 60 may further include a secondary or additional charge 63 at an exterior of the firing barrel 61. This secondary or additional charge 63 may be sized and configured to propel the sea anchor 520 outwardly from the payload section 23 upon or immediately following deployment of the harpoon 51.

The charge 62 may include or be provided as an explosive charge that is set off by an electrical fuse 621 (see FIGS. 5 and 9) that is controlled by the deployment system 60, the processing unit 75 or another suitable control system. For example, in the embodiments of FIGS. 9 and 10, once the nosecone 22 is separated from the payload section 23, the flange 511 may protrude outwardly from a front of the payload section 23 and may include pressure sensors 620 (see FIG. 9) which are coupled to the charge 62. Here, the delivery system 40 is operated such that the non-lethal weapon 10 moves toward and then into the hull of the target such that the flange 511 is disposed to impact with the hull of the target. This impact is sensed by the pressure sensors 620 which send an electrical signal to the charge 62 which sets off the charge 62.

Alternatively, the charge 62 may be a contact fuse that is set off by pressurization. In such cases, in the embodiments of the FIGS. 6 and 8, once the nosecone 22 is separated from the payload section 23, the sharp forward point 516 of the harpoon 51 may protrude outwardly from a front of the payload section 23. Here, the delivery system 40 is operated such that the non-lethal weapon 10 moves toward and then into the hull of the target such that the sharp forward point 516 is disposed to impact with the hull of the target. This impact drives the harpoon 51 slightly backward through the firing barrel 61 such that the barrel 510 impinges upon and pressurizes the charge 62. This action sets off the contact fuse of the charge 62.

In any case, the charge 62 may include propellant of varying velocity to allow the harpoon 51 to be propelled forward at a velocity which is in accordance with the target's estimated hull thickness while preventing complete hull penetration. In an exemplary case, the charge 62 may be formed of propellant which may be initiated at one of several points which takes advantage of the fact that a propellant charge burns most efficiently when ignited at the furthest point from the harpoon 51 and which would thus vary the final velocity of the harpoon 51. In accordance with additional or alternative embodiments, the charge 62 may be formed of high velocity propellant in the rear, low velocity propellant in the front and medium velocity propellant in the center.

In accordance with further embodiments, the guidance system 30 and the delivery system 40 may be further configured to provide a boost for the deployment system 60 at the point of deployment. In an exemplary case, this capability may involve a late or last second speed increase which can be provided by the delivery system 40 as the non-lethal weapon 10 nears the target. This may be employed when it is determined that the deployment system 60 requires an additional boost to insure that the harpoon 51 penetrates the hull of a particularly well defended or thick-hulled target. Here, the increase in speed of the non-lethal weapon 10 effectively results in the harpoon 51 being deployed with a correspondingly increased speed.

Figure 11:
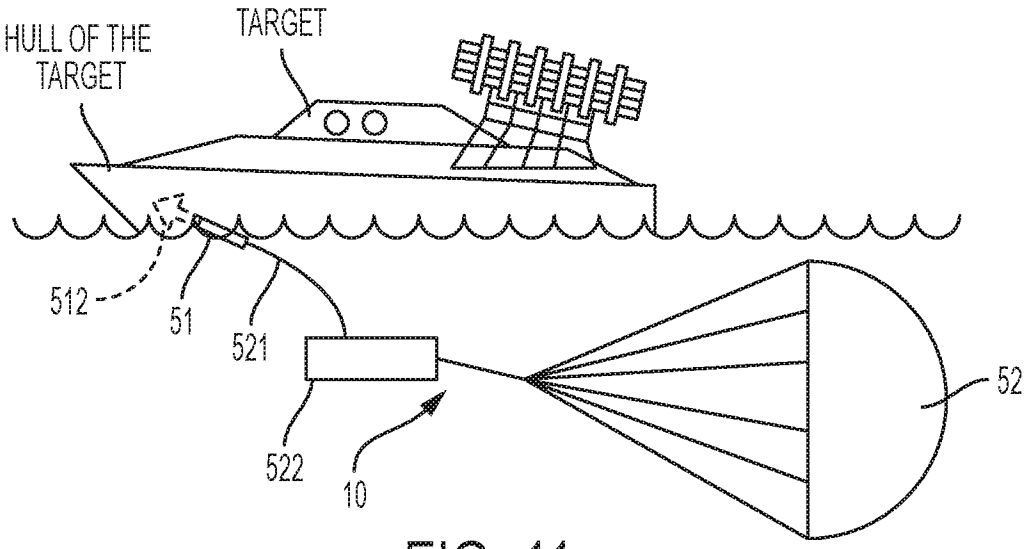
FIG. 11 is a graphical depiction of an operation of a non-lethal weapon in accordance with embodiments.

With reference back to FIGS. 5 and 7 and with additional reference to FIG. 11, an operation of the non-lethal weapon 10 will be described. As shown in FIG. 11, once the non-lethal weapon 10 is launched and the nosecone 22 is separated from the payload section 23, the payload 50 is deployed into the hull of the target (in this case a single small vessel which may be selected from a swarm of small vessels). The barbed front end 512 of the harpoon 51 (see FIG. 5) thus penetrates through the hull and the flange 511 (see FIG. 7) seals any hole in the hull of the target that the harpoon 51 may have created. The barbed front end 512 then prevents withdrawal of the harpoon 51 from the hull while the sealant 513 prevents water ingress into the hull of the target and hampers efforts to remove the harpoon 51 from the hull of the target. At this point, the anchoring element 52 engages and remains coupled to the harpoon 51 by the tether 521. The anchoring element 52 thus slows down and/or inhibits a steering of the target.

Figure 12:
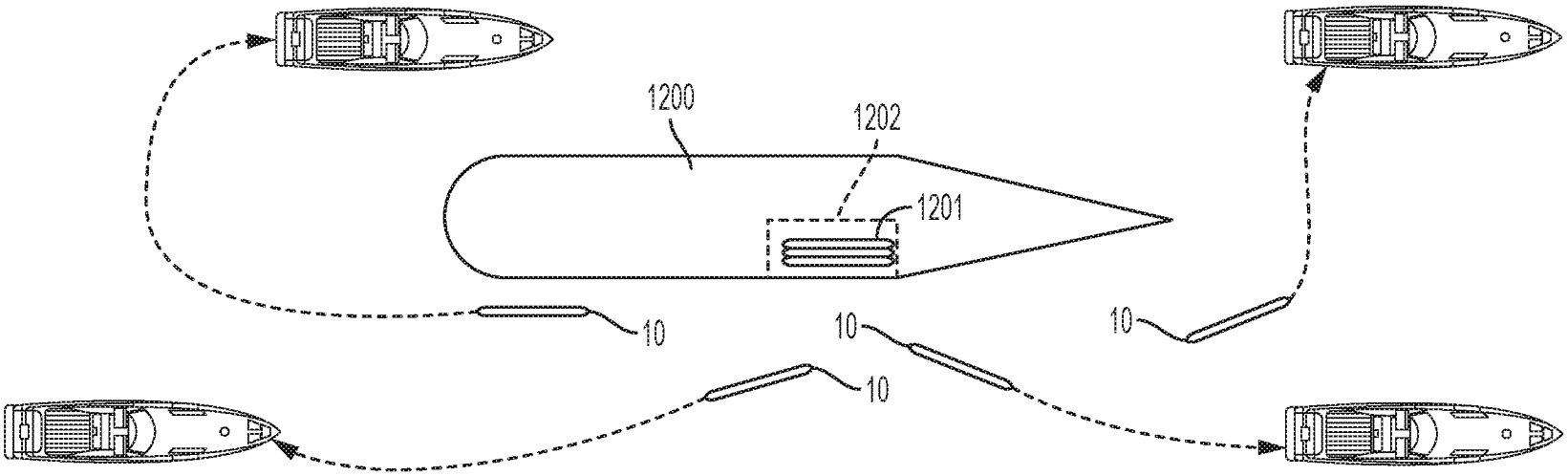
FIG. 12 is a graphical depiction of an operation of a non-lethal weapons system in accordance with embodiments.

With reference to FIG. 12, a non-lethal weapons system 1200 is provided for interdiction of a swarm of small or large naval vessels. The non-lethal weapons system 1200 includes a plurality of non-lethal weapons 10 as described herein, a launcher 1201 which is disposable on a deck, a suitable apparatus of a naval ship or underwater and which is configured to launch each non-lethal weapon 10 into water for interdiction operations and a processor 1202. The processor 1202 may be configured similarly as the processor 75 described above and is configured to provide and, in some cases, to execute and generate a tactically useful hostile intent assessment alert. The processor 1202 may be further configured to provide such tactically useful hostile intent assessment alert to a launch operator whereby the non-lethal weapon 10 can be initiated, engaged, activated, etc. The processor 1202 may be further configured to manage identification and targeting of corresponding ones of the naval vessels for each of the non-lethal weapons 10. In this way, the non-lethal weapons 10 can be controlled at a high command level and, in an exemplary case, no two non-lethal weapons 10 would have a same target unless that situation was specifically called for (i.e., the target is a relatively large vessel which could only be slowed down by multiple non-lethal weapons 10 acting against it in concert with one another).

In accordance with embodiments, the launcher 1201 may not be on a ship at all. In such cases, the non-lethal weapon 10 may be provided as an air-dropped weapon that is dropped from an aircraft, such as a helicopter, for example. This particularly allows for the deployment of multiple non-lethal weapons 10 near one or more targets to thereby decrease a range requirement for the individual non-lethal weapons 10. This, in turn, has the benefit of decreasing size, weight, propulsion and power requirements and costs of the non-lethal weapon 10.

Figure 13:
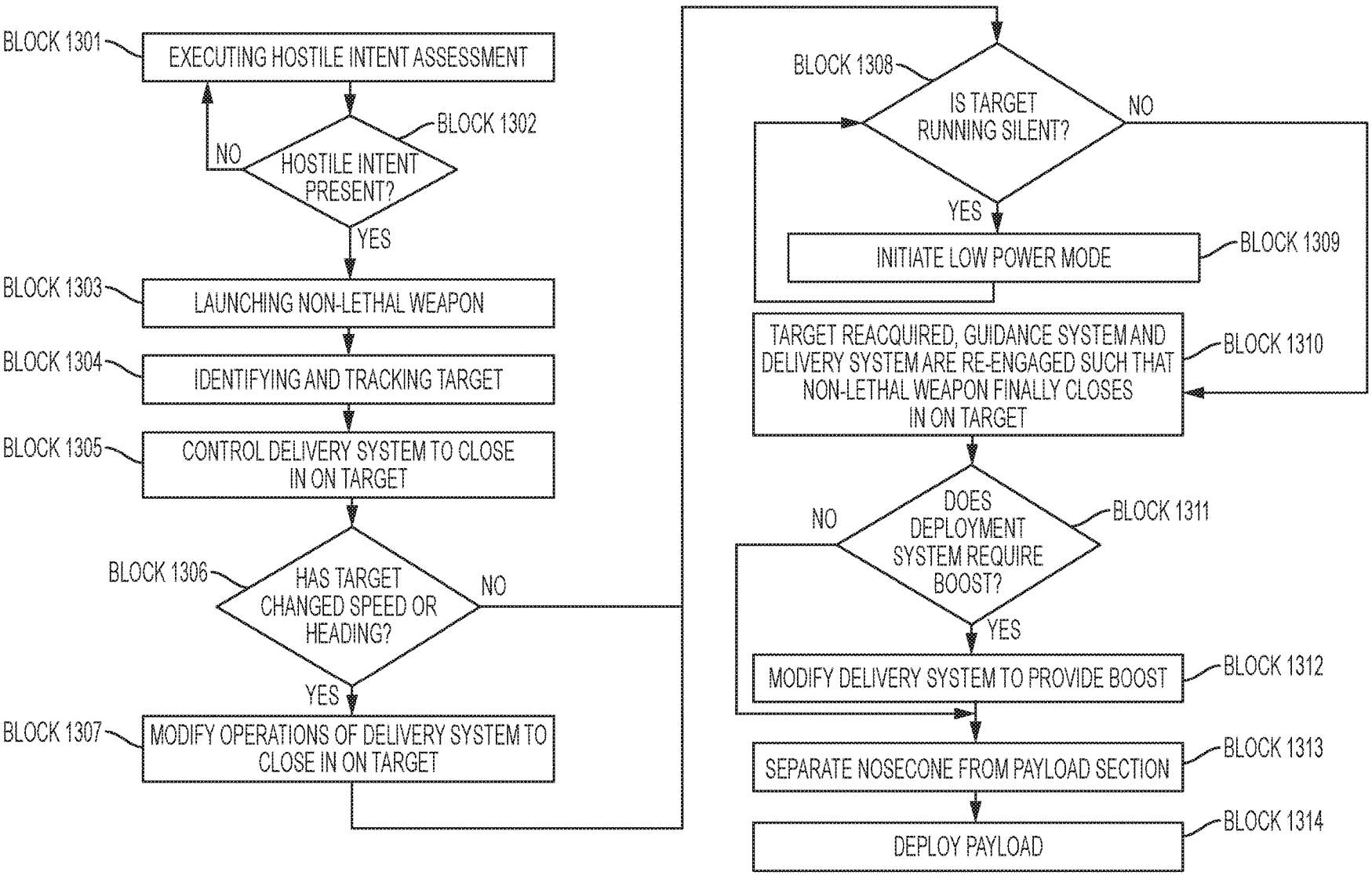
FIG. 13 is a flow diagram illustrating an operational sequence of at least guidance and delivery systems of a non-lethal weapon in accordance with embodiments.

With reference to FIG. 13, a method of operating the non-lethal weapon 10 described herein is provided. As shown in FIG. 13, the method includes executing a hostile intent assessment protocol (block 1301) and determining whether a given situation is associated with a hostile threat which is appropriately addressed by use of the non-lethal weapon 10 (block 1302). In an event the determining of block 1302 returns a negative or false result, control reverts to the execution of the hostile intent assessment protocol of block 1301. Alternatively, in an event the determining of block 1302 returns a positive or true result, the non-lethal weapon 10 is launched (block 1303). At this point, the method includes identifying and tracking a target by the guidance system 30 (block 1304) and accordingly controlling operations of the delivery system 40 to allow the non-lethal weapon 10 to close in on the target (block 1305).

At this point, it may be determined whether the target has changed speed or heading (block 1306) and, if so, the operations of the delivery system 40 will be correspondingly modified such that the non-lethal weapon 10 can continue to close in on the target (block 1307). At a next operation, it may be determined whether the target has begun to run silently or is shut down (block 1308) and, if so, at least the guidance system 30 and the delivery system 40 may initiate a low power mode (block 1309) so as to save fuel and energy. It can then be re-determined whether the target has continued to run silently or is shut down (block 1308).

When it is determined that the target is not running silent (block 1308), and once the target is reacquired, the guidance system 30 and the delivery system 40 are re-engaged such that the non-lethal weapon 10 finally closes in on the target (block 1310). At this point, it can be determined whether the deployment system 60 requires a boost (block 1311) and, if so, an operation of the delivery system 40 may be modified to provide the required boost (block 1312). Then, the deployment system 60 may control the cutting system 24 to separate the nosecone 22 from the payload section 23 (block 1313) and may subsequently deploy the payload 50 (block 1314).

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A non-lethal weapons system for interdiction of a swarm of naval vessels, the non-lethal weapons system comprising:

non-lethal weapons;

a launcher configured to launch each non-lethal weapon into water for interdiction operations; and a processor configured to provide a tactically useful hostile intent assessment alert and to manage identification and targeting of a corresponding naval vessel for each of the non-lethal weapons, each non-lethal weapon comprising a hydrodynamic hull, guidance and delivery systems housed in the hydrodynamic hull with the delivery system being controllable by the guidance system to drive a naval vessel impeding payload toward the corresponding naval vessel and a deployment system configured to prepare the hydrodynamic hull for payload deployment and to deploy the naval vessel impeding payload toward the corresponding naval vessel following hull preparation.

2. The non-lethal weapons system according to claim 1, wherein the launcher is operably disposable on a deck of a naval ship.

3. The non-lethal weapons system according to claim 1, wherein the hydrodynamic hull comprises a nosecone section and a payload section aft of the nosecone section.

4. The non-lethal weapons system according to claim 3, wherein:

the naval vessel impeding payload is at least partially disposable in an interior of the payload section, preparation for payload deployment by the deployment system comprises separating the nosecone from the payload section, and deployment of the naval vessel impeding payload by the deployment system comprises deployment from the interior of the payload section.

5. The non-lethal weapons systems according to claim 1, wherein the naval vessel impeding payload comprises:

a harpoon comprising a barrel, a flange and a barbed front end, the harpoon being attachable to the target by the barbed front end being forcibly injectable through a hull of the target such that the harpoon continues to travel until the flange abuts with the hull of the target whereupon the barbed front end engages and impedes withdrawal from the hull of the target; and an anchoring element coupled to the harpoon and configured to anchor the target with the harpoon attached thereto, the anchoring element comprising a sea anchor and a tether by which the sea anchor is connected to the barrel.

6. A non-lethal weapons system for interdiction of a swarm of naval vessels, the non-lethal weapons system comprising:

non-lethal weapons; and a launcher configured to launch each non-lethal weapon into water for interdiction operations, each non-lethal weapon comprising a hydrodynamic hull, guidance and delivery systems housed in the hydrodynamic hull with the delivery system being controllable by the guidance system to drive a naval vessel impeding payload toward the corresponding naval vessel and a deployment system configured to prepare the hydrodynamic hull for payload deployment and to deploy the naval vessel impeding payload toward the corresponding naval vessel following hull preparation.

7. The non-lethal weapons system according to claim 6, further comprising a processor configured to provide a tactically useful hostile intent assessment alert.

8. The non-lethal weapons system according to claim 7, wherein the processor is further configured to provide the tactically useful hostile intent assessment alert to an operator of the launcher.

9. The non-lethal weapons system according to claim 7, wherein the processor is further configured to manage identification and targeting of a corresponding naval vessel for each of the non-lethal weapons.

10. The non-lethal weapons system according to claim 7, wherein the processor is further configured to manage identification and targeting of corresponding ones of the naval vessels for each of the non-lethal weapons.

11. The non-lethal weapons system according to claim 6, wherein the launcher is operably disposable on a deck of a naval ship.

12. The non-lethal weapons system according to claim 6, wherein:

the hydrodynamic hull comprises a nosecone section and a payload section aft of the nosecone section in an interior of which the naval vessel impeding payload is at least partially disposable, preparation for payload deployment by the deployment system comprises separating the nosecone from the payload section, and deployment of the naval vessel impeding payload by the deployment system comprises deployment from the interior of the payload section.

13. The non-lethal weapons systems according to claim 6, wherein the naval vessel impeding payload comprises:

a harpoon comprising a barrel, a flange and a barbed front end, the harpoon being attachable to the target by the barbed front end being forcibly injectable through a hull of the target such that the harpoon continues to travel until the flange abuts with the hull of the target whereupon the barbed front end engages and impedes withdrawal from the hull of the target; and an anchoring element coupled to the harpoon and configured to anchor the target with the harpoon attached thereto, the anchoring element comprising a sea anchor and a tether by which the sea anchor is connected to the barrel.

14. The non-lethal weapons system according to claim 1, wherein preparation for payload deployment by the deployment system comprises separating the nosecone from the payload section.

15. The non-lethal weapons system according to claim 1, wherein:

the naval vessel impeding payload comprises a harpoon comprising a barrel, a flange and a barbed front end, and the harpoon is attachable to the target by the barbed front end being forcibly injectable through a hull of the target such that the harpoon continues to travel until the flange abuts with the hull of the target whereupon the barbed front end engages and impedes withdrawal from the hull of the target.

16. The non-lethal weapons system according to claim 1, wherein the naval vessel impeding payload further comprises an anchoring element comprising a sea anchor and a tether by which the sea anchor is connected to the barrel.

17. The non-lethal weapons system according to claim 6, wherein preparation for payload deployment by the deployment system comprises separating the nosecone from the payload section.

18. The non-lethal weapons systems according to claim 6, wherein:

the naval vessel impeding payload comprises a harpoon comprising a barrel, a flange and a barbed front end, and the harpoon is attachable to the target by the barbed front end being forcibly injectable through a hull of the target such that the harpoon continues to travel until the flange abuts with the hull of the target whereupon the barbed front end engages and impedes withdrawal from the hull of the target.

19. The non-lethal weapons system according to claim 6, wherein the naval vessel impeding payload further comprises an anchoring element comprising a sea anchor and a tether by which the sea anchor is connected to the barrel.

* * * * *